US010758101B2

(12) United States Patent
Fogarty, Jr. et al.

(10) Patent No.: US 10,758,101 B2
(45) Date of Patent: Sep. 1, 2020

(54) UPRIGHT VACUUM CLEANER WITH BATTERY SUPPORT PLATE

(71) Applicant: Emerson Electric Co., St. Louis, MO (US)

(72) Inventors: Thomas E. Fogarty, Jr., Alton, IL (US); John L. Theising, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 318 days.

(21) Appl. No.: 15/620,213

(22) Filed: Jun. 12, 2017

(65) Prior Publication Data

US 2018/0353038 A1 Dec. 13, 2018

(51) Int. Cl.

| | |
|---|---|
| ***A47L 9/28*** | (2006.01) |
| ***A47L 9/24*** | (2006.01) |
| ***A47L 5/30*** | (2006.01) |
| ***A47L 9/04*** | (2006.01) |
| ***A47L 9/32*** | (2006.01) |

(52) U.S. Cl.

CPC ..... *A47L 9/2884* (2013.01); *A47L 5/30* (2013.01); *A47L 9/0411* (2013.01); *A47L 9/0444* (2013.01); *A47L 9/0477* (2013.01); *A47L 9/24* (2013.01); *A47L 9/28* (2013.01); *A47L 9/2878* (2013.01); *A47L 9/325* (2013.01)

(58) Field of Classification Search

CPC ..... A47L 9/2884; A47L 9/2878; A47L 9/24

See application file for complete search history.

(56) References Cited

U.S. PATENT DOCUMENTS

| | | | | |
|---|---|---|---|---|
| 4,665,582 | A | 5/1987 | Richmond et al. | |
| 6,245,159 | B1 | 6/2001 | Deng | |
| 6,311,366 | B1 | 11/2001 | Sepke et al. | |
| 8,128,815 | B1 | 3/2012 | Simmons | |
| 2002/0053115 | A1 | 5/2002 | Deng | |
| 2004/0216266 | A1 | 11/2004 | Conrad | |
| 2007/0101536 | A1 | 5/2007 | Nielsen | |
| 2007/0136984 | A1 | 6/2007 | Hsu | |
| 2007/0226946 | A1 | 10/2007 | Best | |
| 2009/0056060 | A1 | 3/2009 | Han et al. | |
| 2010/0192314 | A1* | 8/2010 | Otsuka | A47L 5/24 15/3 |
| 2014/0245564 | A1* | 9/2014 | Conrad | A47L 9/1683 15/353 |

(Continued)

FOREIGN PATENT DOCUMENTS

| | | | |
|---|---|---|---|
| EP | 2030543 | A2 | 3/2009 |
| EP | 2392244 | A2 | 12/2011 |

(Continued)

OTHER PUBLICATIONS

Hoover Linx BH50010 Cordless Stick Vacuum Cleaner, <https://www.amazon.com/Hoover-BH50010-Cordless-Vacuum-Cleaner/dp/B001PB8EJ2>, accessed on Jan. 16, 2017, 9pp.

*Primary Examiner* — Andrew A Horton

(74) *Attorney, Agent, or Firm* — Armstrong Teasdale LLP

(57) ABSTRACT

Battery-powered upright vacuum cleaners are disclosed. The vacuum cleaner includes a battery support plate from which the battery is suspended. The battery support plate is connected to a debris tube of the vacuum cleaner. In some embodiments, the debris tube includes mounting members that are received in recesses formed within the battery support plate.

19 Claims, 14 Drawing Sheets

(56) References Cited

U.S. PATENT DOCUMENTS

| | | | | |
|---|---|---|---|---|
| 2015/0143659 | A1* | 5/2015 | Pilch | A47L 9/1691 15/347 |
| 2015/0145444 | A1* | 5/2015 | Reed | A47L 9/0411 318/139 |
| 2016/0051109 | A1 | 2/2016 | Hwang et al. | |
| 2016/0088987 | A1 | 3/2016 | Hwang et al. | |
| 2016/0106285 | A1 | 4/2016 | Jenson | |
| 2017/0042400 | A1 | 2/2017 | Lee et al. | |

FOREIGN PATENT DOCUMENTS

| | | | |
|---|---|---|---|
| GB | 2343837 | A | 5/2000 |
| WO | 2016061521 | A1 | 4/2016 |

* cited by examiner

UPRIGHT VACUUM CLEANER WITH BATTERY SUPPORT PLATE

FIELD

The field relates to upright vacuum cleaners and, in particular, battery-powered upright vacuum cleaners.

BACKGROUND

Vacuum cleaners typically include a power cord that extends from the vacuum cleaner and connects to a power source. During operation, the maneuverability of the vacuum cleaner may be limited by the power cord. In addition, the vacuum cleaner may not be able to reach some areas while the power cord is connected to the power source. Moreover, the power cord may experience stress and may be disconnected from the vacuum or the power source as a user attempts to maneuver the vacuum cleaner.

Upright vacuum cleaners may be powered by a battery in a cordless mode to improve maneuverability of the vacuum cleaner. Conventional battery-powered upright vacuum cleaners are often underpowered and/or may not be well suited for larger battery systems. A need exists for an upright vacuum cleaner that can support relatively large battery systems such as 92 volt battery systems.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed to an upright vacuum cleaner. The vacuum cleaner includes a cleaning head for removing debris from a floor and into the vacuum cleaner and a filter assembly to filter and collect debris from an airstream. A debris tube is connected to the cleaning head and filter assembly. The debris tube is further connected to the cleaning head. The vacuum cleaner includes a battery support plate adapted to support a battery. The battery support plate is attached to the debris tube.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
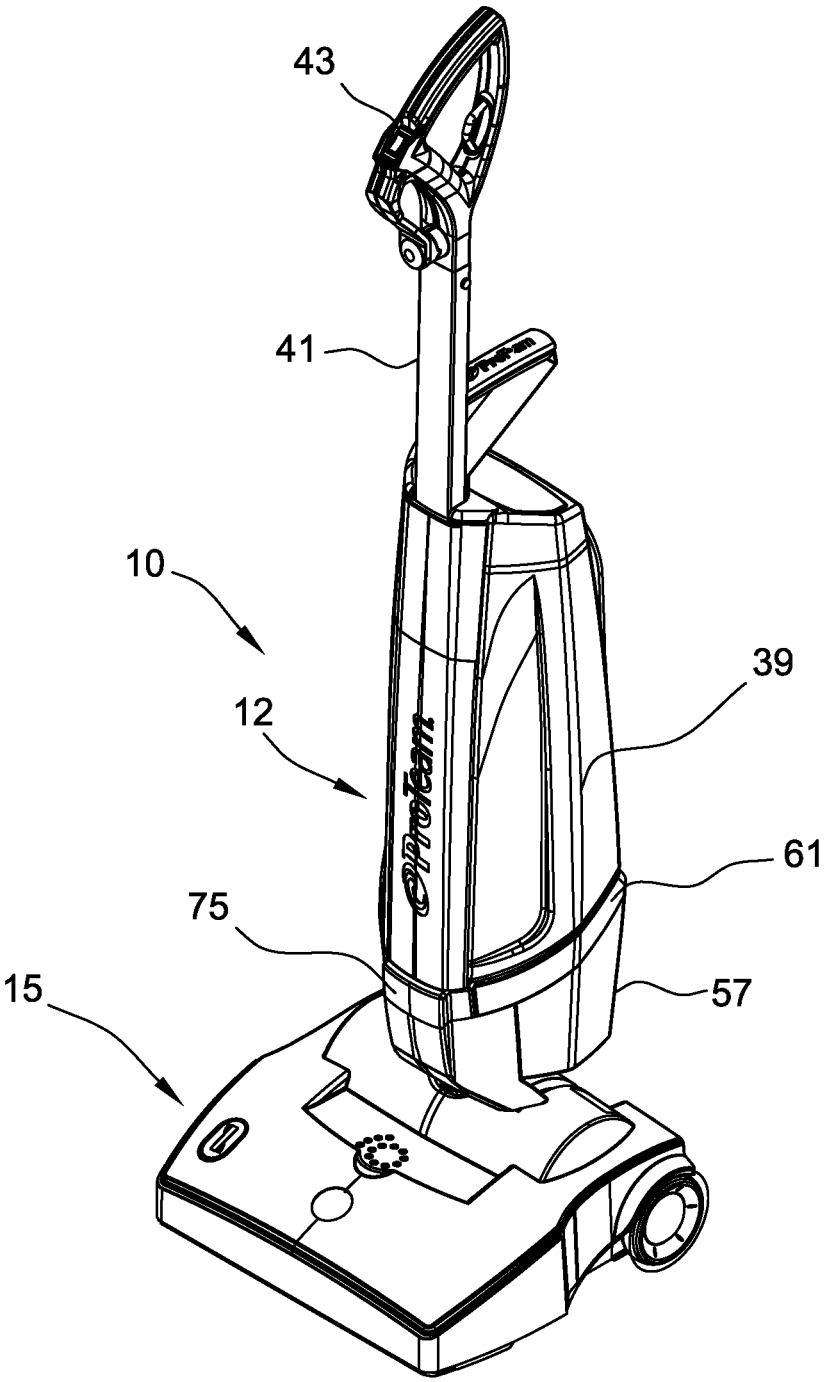
FIG. 1 is a perspective view of an upright vacuum cleaner.
Figure 2:
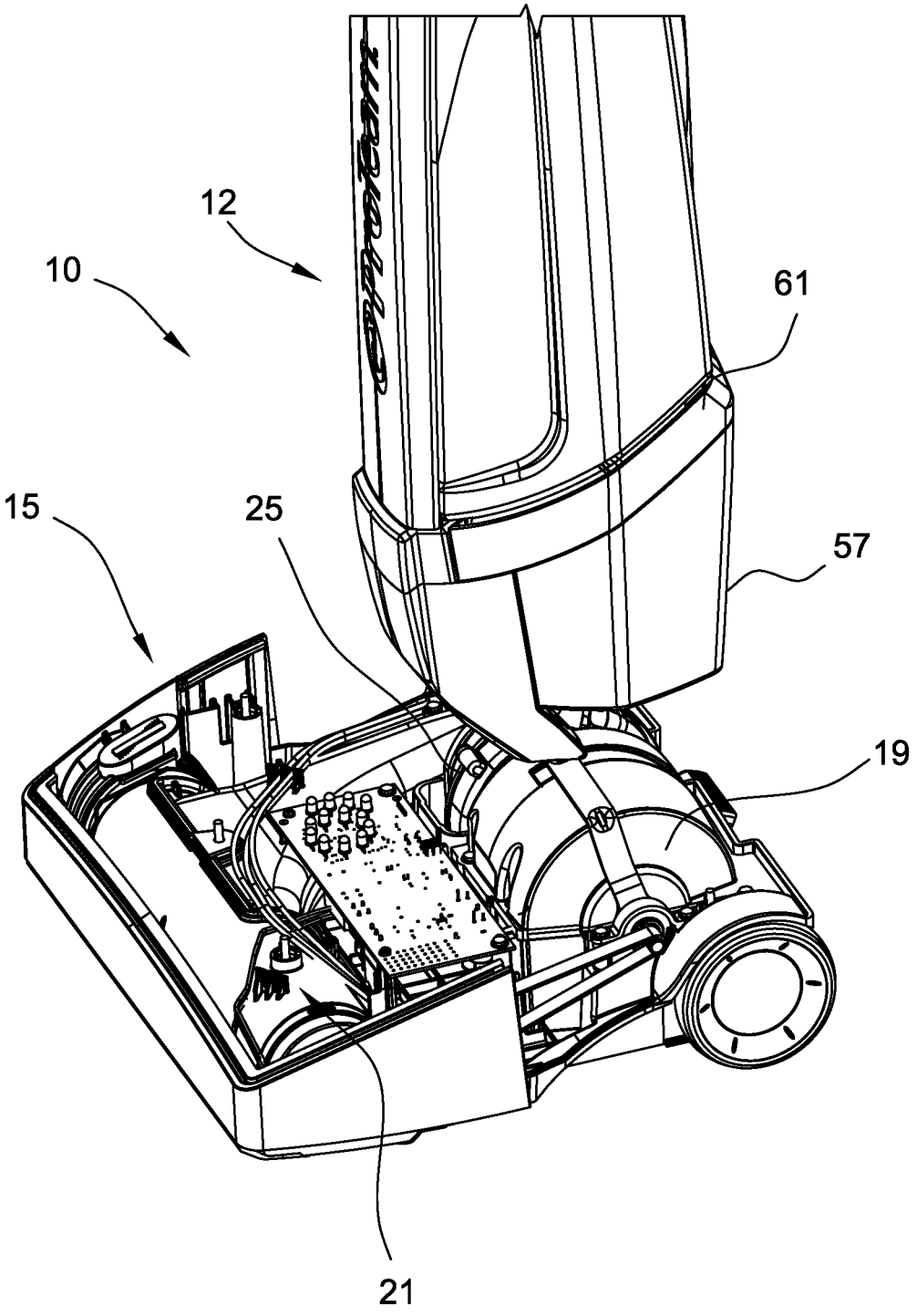
FIG. 2 is a detailed perspective view of the cleaning head of the vacuum cleaner.
Figure 3:
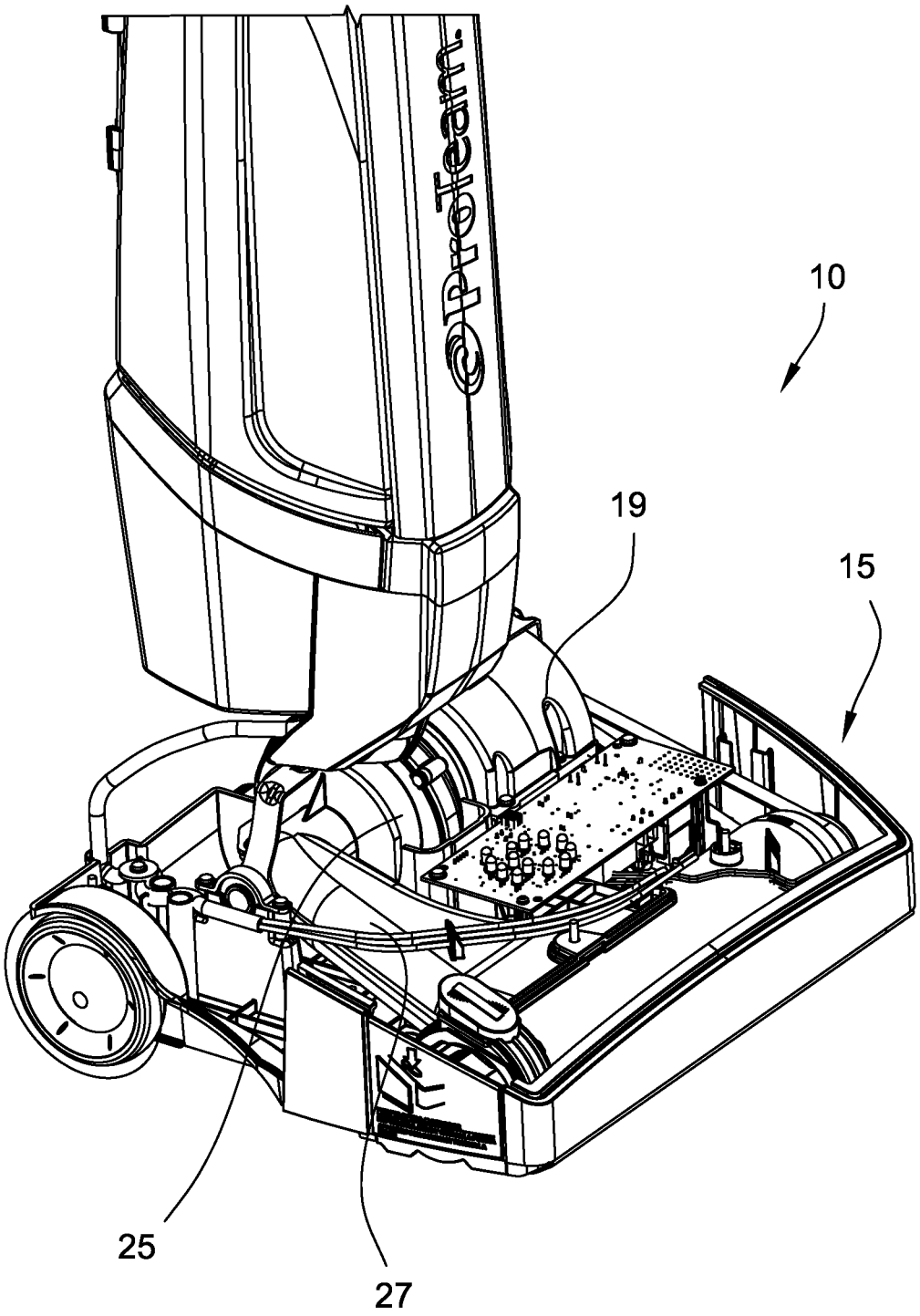
FIG. 3 is another detailed perspective view of the cleaning head.

FIG. 1 is a perspective view of an example vacuum cleaning system 10. The vacuum cleaning system 10 includes an upright vacuum cleaner 12 and battery 57. The vacuum cleaner 12 includes a cleaning head 15 for removing debris from a floor and into the vacuum cleaner 12. The cleaning head 15 includes a motor assembly 19 (FIG. 2) having a motor that powers a brush unit 21. The brush unit 21 includes one or more brushes (not shown) that rotate and contact the floor to agitate debris to promote entrainment of the debris into an airflow pulled within the vacuum cleaner. A blower or fan 25 pulls air and debris from the brush unit 21, through a blower housing 27 (FIG. 3) and into the blower 25. The blower 25 pushes the air and debris into a debris tube 31 (FIG. 4) that extends upward from the cleaning head 15. The debris tube 31 is pivotally attached to the cleaning head 15.

Figure 4:
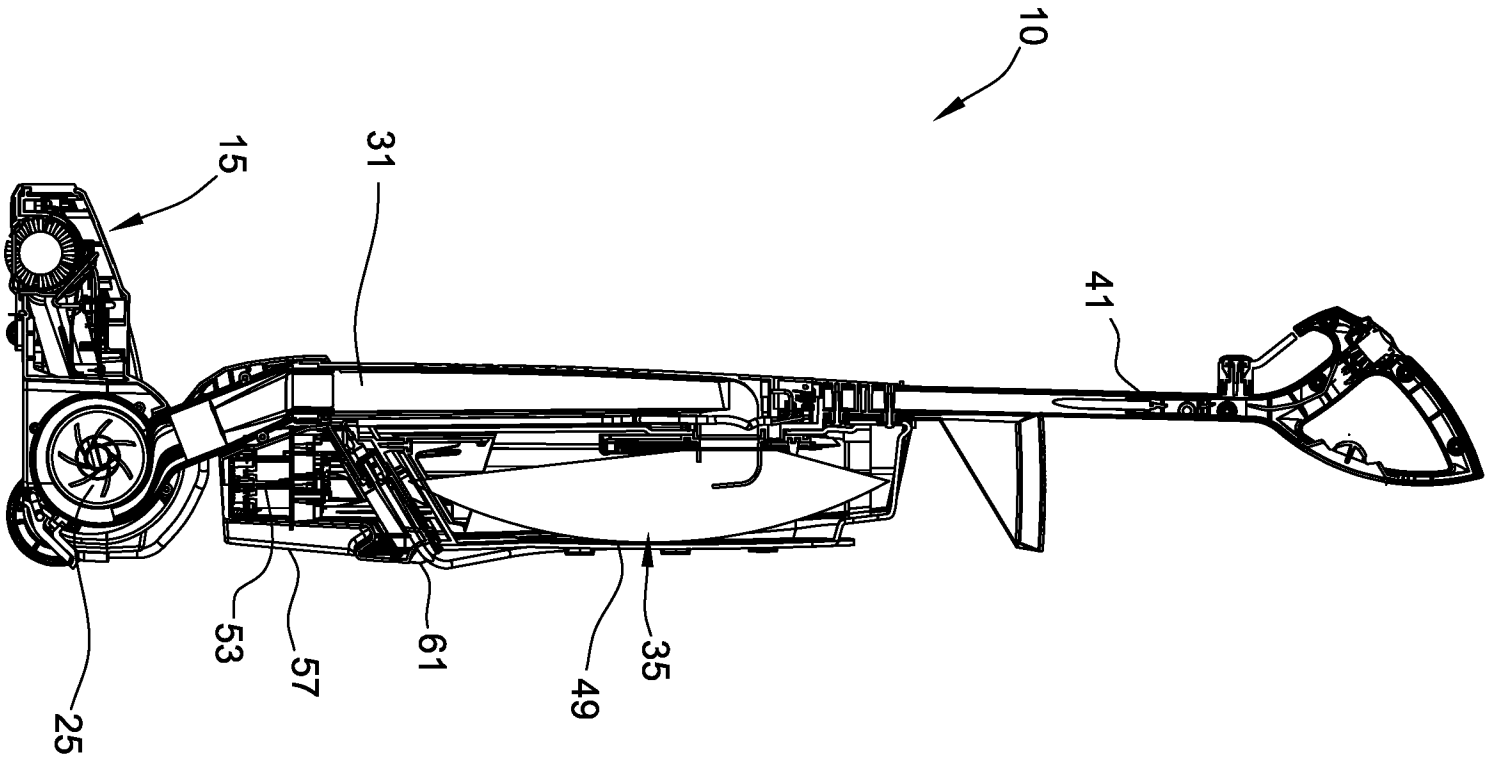
FIG. 4 is a cross-section side view of the vacuum cleaner.
Figure 5:
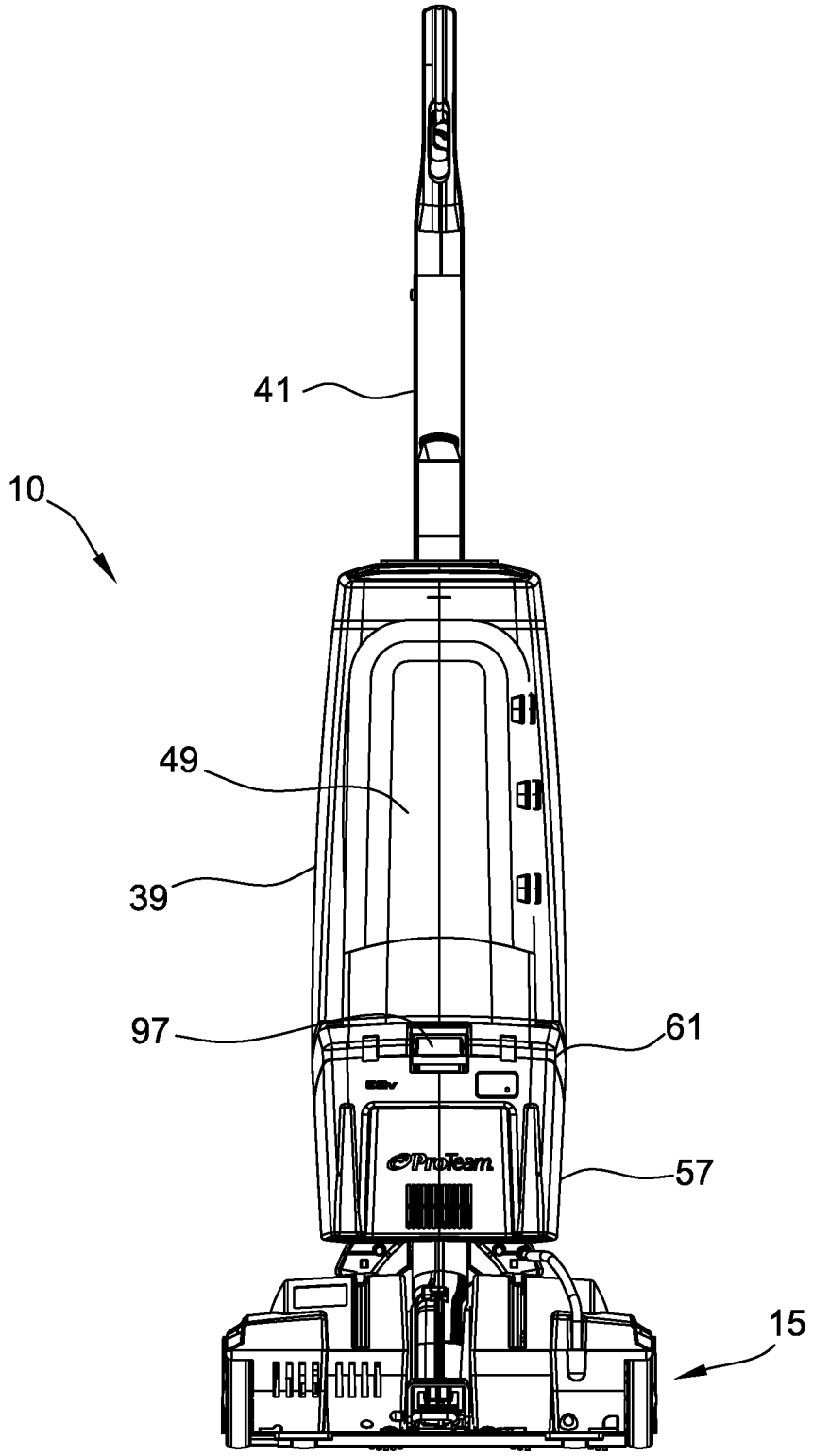
FIG. 5 is a rear view of the vacuum cleaner.

Referring now to FIG. 4, the debris tube 31 is fluidly connected to the blower 25 and a filter assembly 35. Air and debris travel up the debris tube 31 and are discharged into the filter assembly 35. The filter assembly 35 filters and collects debris from the airstream. The filter assembly 35 is disposed within a filter housing 39 (FIG. 5). The filter housing 39 may be rigid (e.g., plastic) or flexible (e.g., flexible thermoformed foam housing with a fabric exterior) or a combination of rigid and flexible components.

The filter housing 39 includes an access door 49 to allow access to the filter assembly 35 (FIG. 4) to allow the filter assembly 35 to be removed or connected to the vacuum cleaner 12. The filter assembly 35 may be a bag filter or panel or cartridge filter. The filter assembly 35 selectively allows air to pass through the filter and retain debris within the filter assembly.

Figure 8:
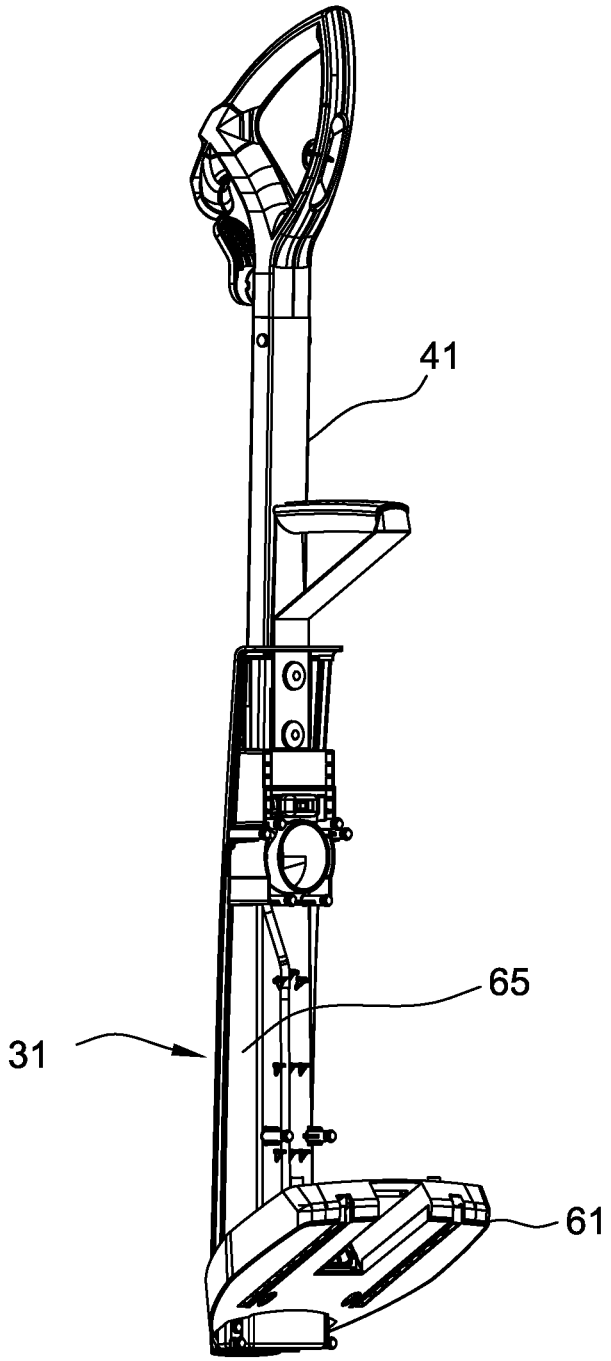
FIG. 8 is a perspective view of the handle assembly, debris tube and battery support plate of the vacuum cleaner.

A handle assembly 41 (FIG. 8) is attached to the debris tube 31. The handle assembly 41 includes a power switch 43 (FIG. 1) that, once actuated, causes the vacuum cleaner 12 to be powered.

Figure 6:
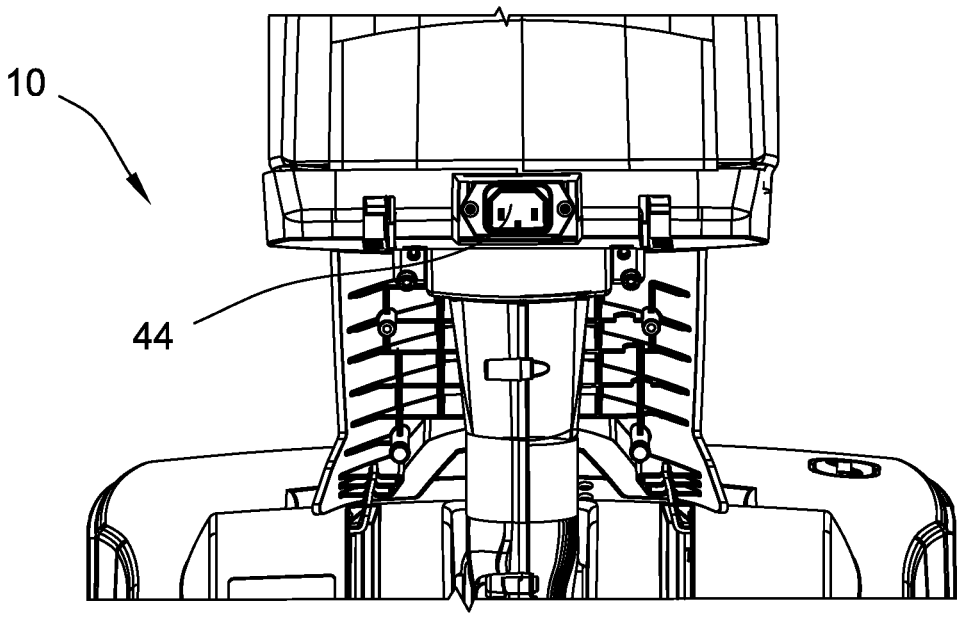
FIG. 6 is a rear view of the upright vacuum cleaner showing an electrical connection interface.
Figure 7:
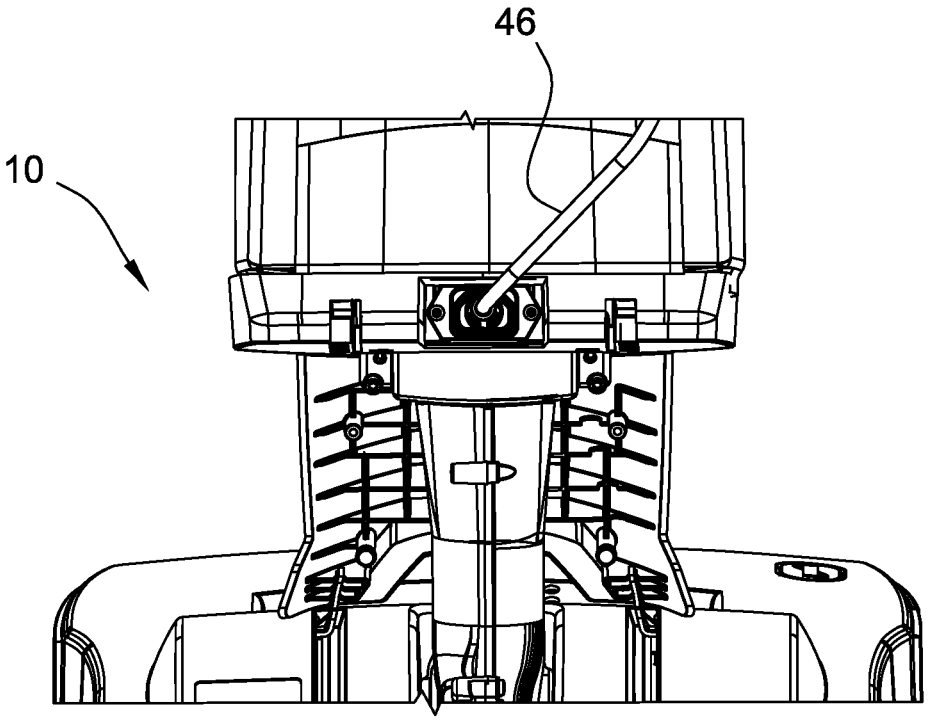
FIG. 7 is a rear view of the vacuum cleaner in a corded mode.

In the illustrated embodiment, the vacuum cleaner 12 may be selectively powered by a battery in a cordless mode (FIGS. 1-5) or by an AC power source (i.e., AC electricity supplied to households and businesses) in a corded mode (FIG. 7). The vacuum cleaner 12 includes an electrical connection interface 44 (shown as a power connector in FIG. 6) for connecting the battery 57 (FIG. 1) or for connecting the power cord 46 (FIG. 7). In other embodiments, the vacuum cleaner 12 is powered only by a battery.

The battery 57 comprises a battery power pack 53 (FIG. 4) having a plurality of rechargeable batteries cells within a casing. The battery cells may include any suitable battery chemistry and design such as lithium ion batteries, lead-acid batteries, nickel-cadmium batteries, nickel-zinc batteries and nickel metal hydride batteries. In some embodiments, the batteries are lithium-ion. In some embodiments, when the battery 57 is at least partially charged, the battery 57 is capable of providing 92-volt, DC power to the vacuum cleaner 12 (e.g., 92.4 VDC). Other suitable output voltages of the battery 57 include, for example and without limitation, about 80 VDC and about 108 VDC.

Figure 9:
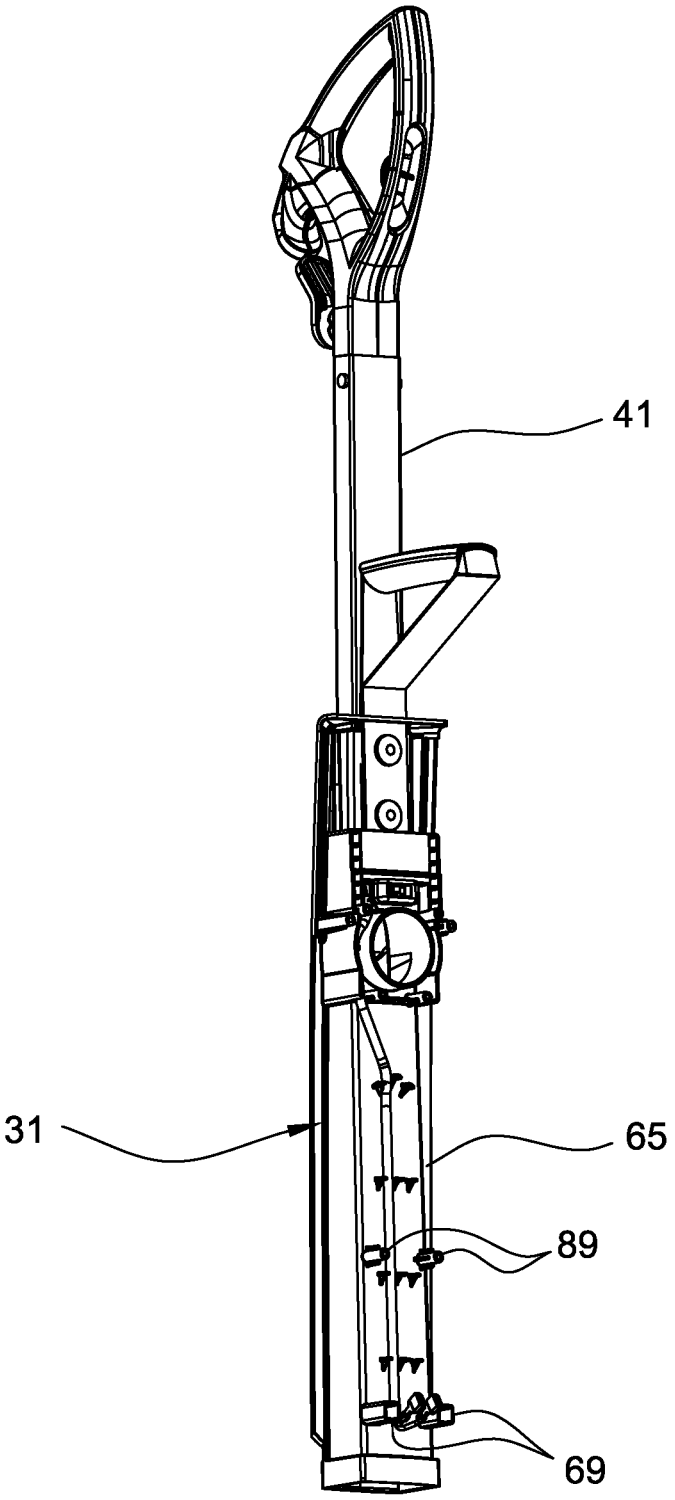
FIG. 9 is a perspective view of the handle assembly and debris tube.

The battery 57 is suspended from a battery support plate 61. The battery support plate 61 (FIG. 8) is attached to the debris tube 31 and is disposed below the filter assembly 35 (FIG. 4). As shown in FIG. 9, the debris tube 31 includes a main body portion 65 and mounting members 69 that extend from the main body portion 65 for supporting the battery support plate 61.

Figure 10:
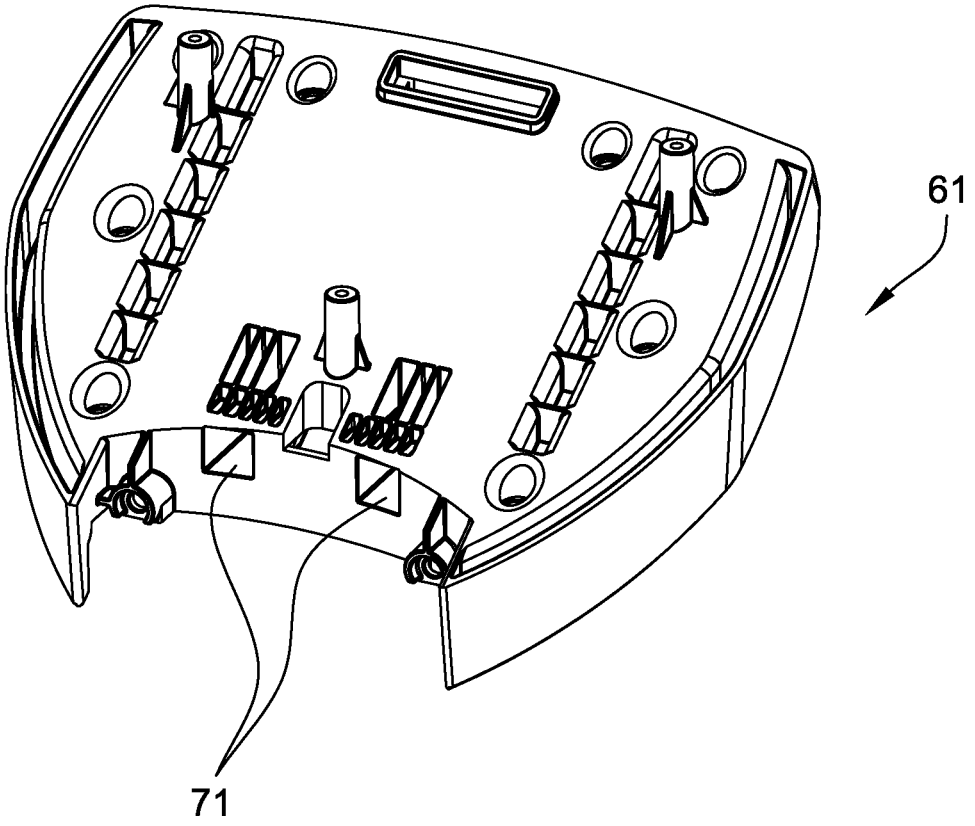
FIG. 10 is a perspective view of the battery support plate.

The battery support plate 61 includes recesses 71 (FIG. 10) formed within the plate 61. The mounting members 69 (FIG. 9) are received in the recesses 71. In the illustrated embodiment, the debris tube 31 includes two mounting members 69 and the battery support plate 61 includes two recesses 71. In other embodiments, the debris tube 31 includes more or less than two mounting members 69 and the battery support plate 61 includes more or less than two recesses 71. In yet other embodiments, the battery support plate 61 includes one or more mounting members that are received in one or more recesses within the debris tube 31.

The battery support plate 61 may be a single piece or may be two or more pieces fastened together by fasteners (e.g., screws).

Figure 11:
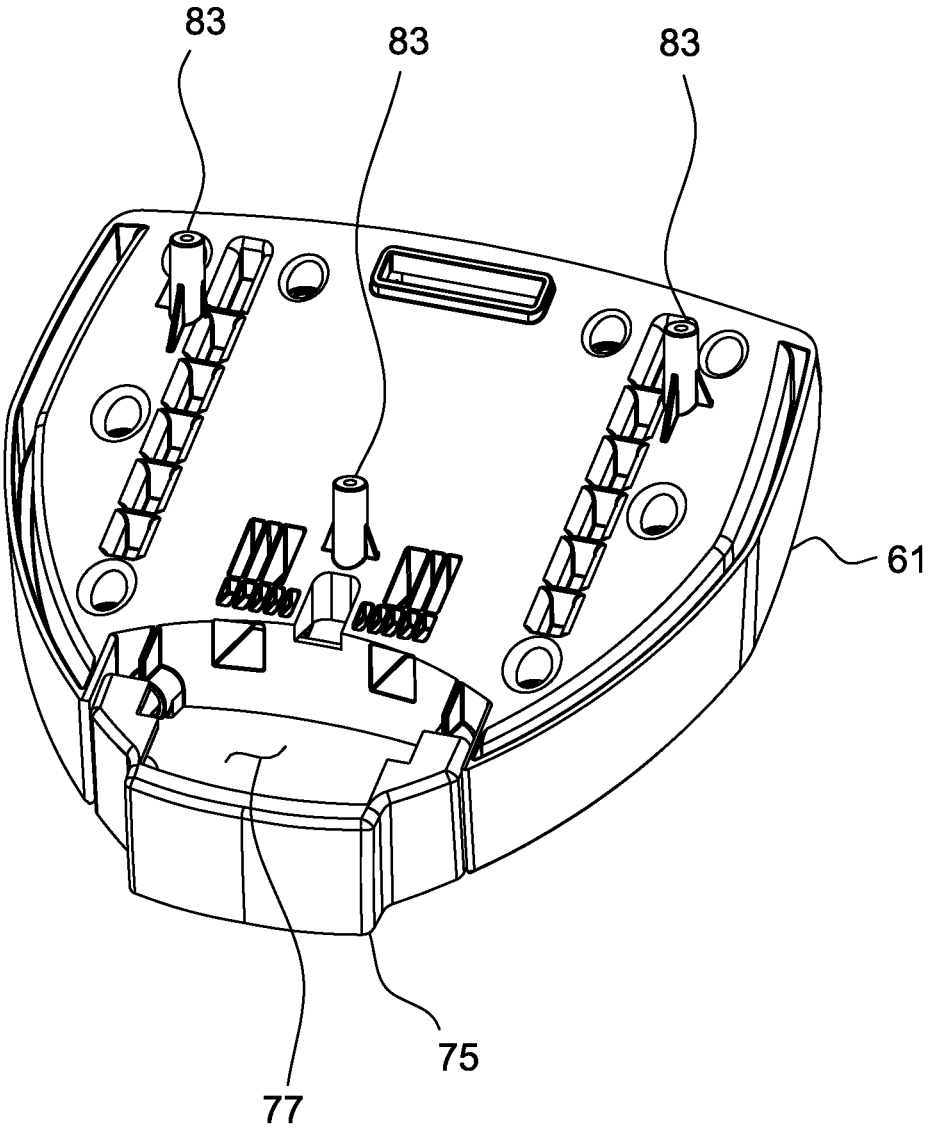
FIG. 11 is a perspective view of the battery support plate and a debris tube bracket.

The vacuum cleaner 12 includes a debris tube bracket 75 (FIG. 11) that fastens to the battery support plate 61. The battery support plate 61 and debris tube bracket 75 form a chamber 77 through which the debris tube 31 (FIG. 9) passes. Bracket fasteners (not shown) fasten the support plate 61 to the debris tube bracket 75.

Figure 12:
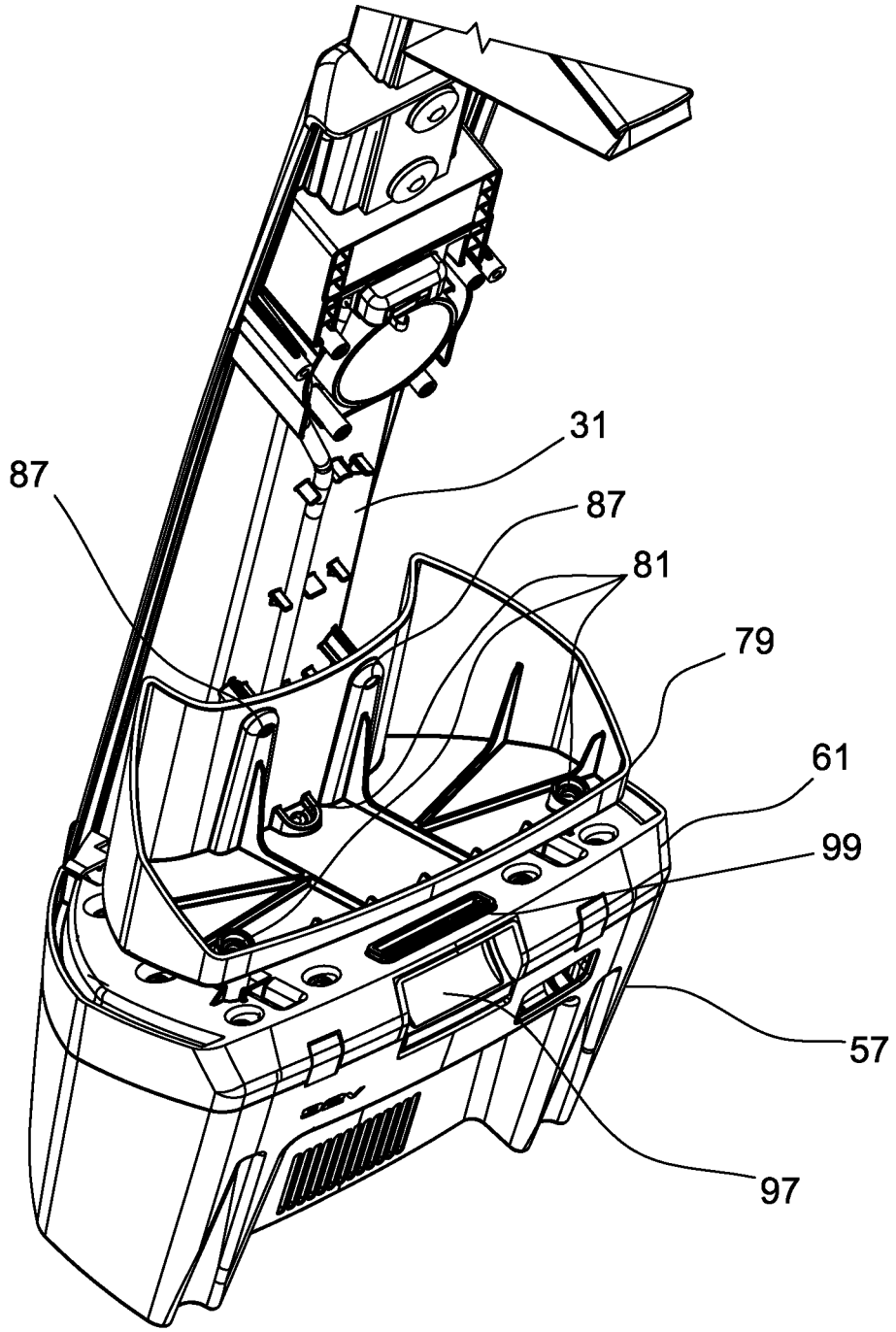
FIG. 12 is a perspective view of the debris tube, battery, battery support plate and support bracket.

A support bracket 79 (FIG. 12) is disposed above and attached to the battery support plate 61. The support bracket 79 includes openings 81 which receive fasteners (not shown) that mate with threaded connections 83 (FIG. 11) of the support plate 61. The support bracket 79 also includes openings 87 that receive fasteners (not shown) that mate with threaded connections 89 (FIG. 9) of the debris tube 31. The filter housing 39 includes a bottom portion (not shown) that is disposed between the support bracket 79 and battery support plate 61 to secure the filter housing 39.

Figure 13:
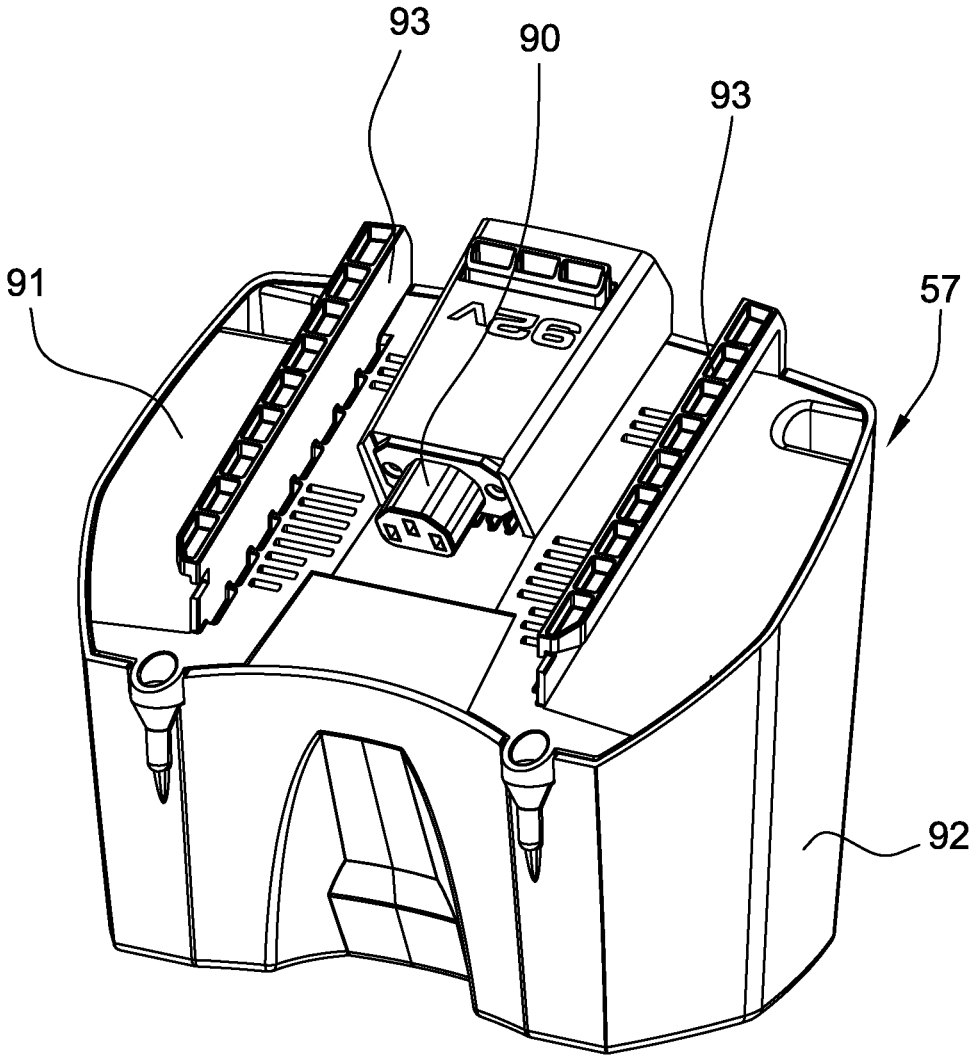
FIG. 13 is a perspective view of the battery.
Figure 14:
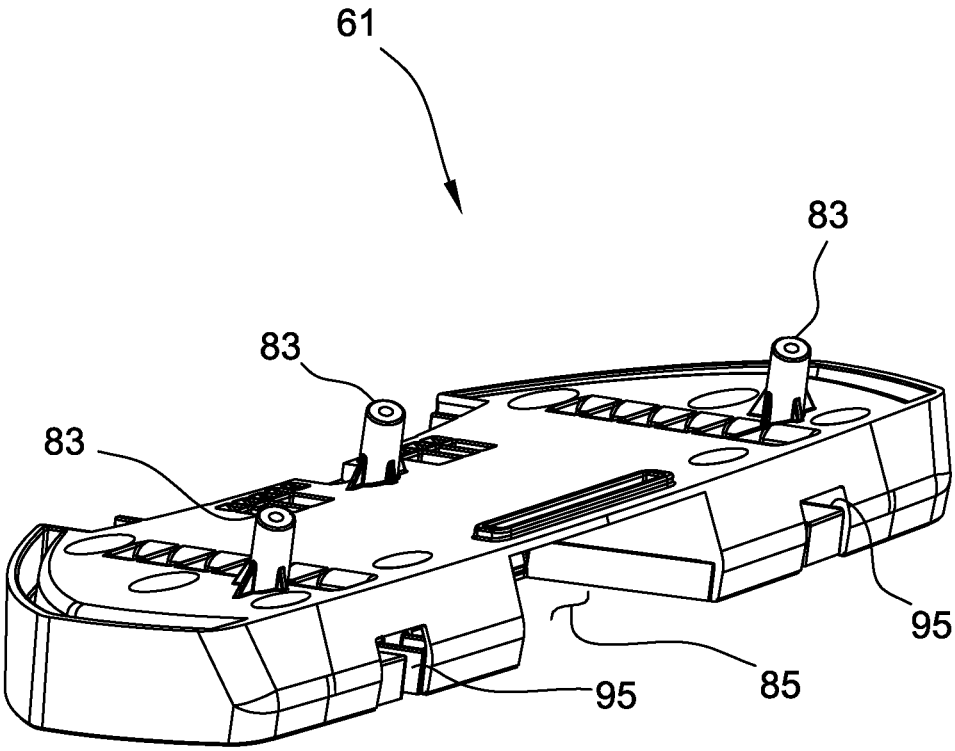
FIG. 14 is a perspective view of the battery support plate.

The battery 57 is releasable attached to the battery support plate 61. Referring now to FIG. 13, the battery 57 includes a cover plate 91 and sidewalls 92 that extend down from the cover plate 91. The cover plate 91 includes two rails 93 that may be received in grooves 95 (FIG. 14) formed in the battery support plate 61. Alternatively, the cover plate 91 may include grooves (not shown) that mate with rails (not shown) of the battery support plate 61. In the illustrated embodiment, the cover plate 91 includes two rails 93 and the battery support plate 61 includes two grooves 95. In other embodiments, the cover plate 91 includes more or less than two rails 93 and the battery support plate 61 includes more or less than two grooves 95.

The battery support plate 61 and grooves 95 thereof angle downward toward the debris tube 31. The rails 93 of the battery cover plate 91 also angle downward (e.g., toward the debris tube 31 when connected to the vacuum cleaner 12).

The battery support plate 61 includes a cavity 85 adapted to receive an electrical connection interface 90 (shown as a power connector in FIG. 13) of the battery 57 to allow the battery to electrically couple to the electrical connection interface 44 (FIG. 6) of the vacuum cleaner 12.

The battery 57 includes a latch 97 (FIG. 12) having an upper portion that fits within an opening 99 formed in the battery support plate 61. Springs (not shown) bias the latch upward. While positioning the battery 57 into the battery support plate 61 by sliding the rails 93 (FIG. 13) into grooves 95 (FIG. 14) of the support plate 61, the latch 97 mates with the opening 99 to lock the battery 57 onto the support plate 61. The latch 97 may be depressed to release the battery 57 from the support plate 61.

Compared to conventional upright vacuum cleaners, the upright vacuum cleaner of embodiments of the present disclosure has several advantages. The battery support plate and battery are configured to allow the battery to be disposed on and removed from the vacuum cleaner. By removably receiving the battery, the vacuum cleaner is configured to be converted from battery power to AC main power. The mounting members that extend from the main body of the debris tube provide support for the battery. This is especially advantageous for larger battery systems such as 92 volt battery systems. As the support bracket is connected to the debris tube and the support plate, the support bracket also supports the weight of the battery. The battery support plate may be relatively low on the handle assembly to create a better weight distribution and a lower center of gravity to reduce the handle weight of the vacuum thereby reducing operator fatigue. In embodiments in which the grooves of the support plate and the battery rails angle downward toward the debris tube, the battery may more easily be removed and disposed on the vacuum cleaner. The weight of the battery assists to dispose the battery on the vacuum cleaner into the locked position.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. An upright vacuum cleaner comprising:

a cleaning head for removing debris from a floor and into the vacuum cleaner;

a filter assembly to filter and collect debris from an airstream;

a debris tube connected to the cleaning head and filter assembly, the debris tube extending from the cleaning head and terminating at a handle assembly;

a battery support plate adapted to support a battery, the battery support plate located on the debris tube and defining an elongate cavity; and an electrical connection interface connected to the battery support plate and adapted for removable connection to each of the battery and a power cord, wherein the electrical connection interface is recessed within the elongate cavity.

2. The upright vacuum cleaner of claim 1 wherein the debris tube comprises a main body portion and a mounting member that extends from the main body portion for supporting the battery support plate.

3. The upright vacuum cleaner of claim 2 wherein the battery support plate comprises a recess, the mounting member being received in the recess.

4. The upright vacuum cleaner of claim 3 wherein the mounting member is a first mounting member and the recess is a first recess, the debris tube comprising a second mounting member and the battery support plate comprising a second recess, the second mounting member being received in the second recess.

5. The upright vacuum cleaner of claim 1 in combination with the battery, the battery comprising a power pack comprising a plurality of rechargeable batteries.

6. The upright vacuum cleaner of claim 5 wherein the battery is removably attached to the battery support plate.

7. The upright vacuum cleaner of claim 6 wherein the battery comprises a cover plate, the cover plate comprising a rail, the rail being removably received within a groove of the battery support plate.

8. The upright vacuum cleaner of claim 7 wherein the rail is a first rail and the groove is a first groove, the cover plate comprising a second rail removably received within a second groove of the battery support plate.

9. The upright vacuum cleaner of claim 7 wherein the rail and groove angle downward toward the debris tube.

10. The upright vacuum cleaner of claim 6 wherein the battery comprises a latch to releasably lock the battery.

11. The upright vacuum cleaner of claim 10 wherein the latch engages the battery support plate when the battery is locked.

12. The upright vacuum cleaner of claim 1 wherein the battery support plate angles downward toward the battery.

13. The upright vacuum cleaner of claim 1 comprising a debris tube bracket attached to the battery support plate, the debris tube bracket and battery support plate forming a chamber, the debris tube passing through the chamber.

14. The upright vacuum cleaner of claim 1 wherein the upright vacuum cleaner is configured to selectively operate under battery power or main AC power.

15. The upright vacuum cleaner of claim 1 comprising a support bracket disposed above the battery support plate, the support bracket being connected to the debris tube and battery support plate.

16. The upright vacuum cleaner of claim 15 wherein the filter assembly includes a filter housing, the filter housing being secured by the support bracket.

17. The upright vacuum cleaner of claim 16 wherein a portion of the filter housing is disposed between the support bracket and the battery support plate.

18. The upright vacuum cleaner of claim 1 wherein the battery support plate comprises a mounting member and the debris tube comprises a recess for receiving the mounting member.

19. The upright vacuum cleaner of claim 1 wherein the battery support plate is disposed below the filter assembly.

* * * * *